United States Patent [19]

Wibroe

[11] 3,936,889

[45] Feb. 10, 1976

[54] TOILET FLUSH MECHANISM

[75] Inventor: Tab Wibroe, Sunnyvale, Calif.

[73] Assignee: The Raymond Lee Organization, Inc., New York, N.Y. ; a part interest

[22] Filed: Aug. 13, 1974

[21] Appl. No.: 496,980

[52] U.S. Cl. ..... 4/37; 4/67 A

[51] Int. Cl.[2] ..... E03D 1/14

[58] Field of Search ..... 4/67 A, 34, 57 P, 37, 67 R, 4/57 R

[56] References Cited

UNITED STATES PATENTS

| | | | |
|---|---|---|---|
| 2,526,294 | 10/1950 | Stegeman | 4/67 A |
| 2,809,378 | 10/1957 | Newton | 4/67 A |
| 2,950,483 | 8/1960 | Richards | 4/67 A |

*Primary Examiner*—Houston S. Bell, Jr.
*Attorney, Agent, or Firm*—Howard I. Podell

[57] ABSTRACT

An improved toilet flush mechanism which upon actuation, permits either a limited amount of water to flow from the tank or the full amount of water to flow from the tank. The mechanism incorporates a pivotable member attached to a float arm which serves to close the opened tank valve as the float arm descends to limit the amount of water dispensed by the tank. When desired, the pivotable member is rotated away from engagement with the tank valve to permit the tank valve to remain open until a full tankful of water has been dispensed from the tank. .

1 Claim, 3 Drawing Figures

TOILET FLUSH MECHANISM

SUMMARY OF THE INVENTION

My invention relates to an improved toilet flush mechanism, and particularly one which permits either a limited amount of water to flow from the tank or the full amount of water to flow from the tank.

The mechanism incorporates a pivotable member attached to a float arm which serves to close the opened tank valve as the float arm descends to limit the amount of water dispensed by the tank. When desired, the pivotable member is rotated away from engagement with the tank valve to permit the tank valve to remain open until a full tankful of water has been dispensed from the tank.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
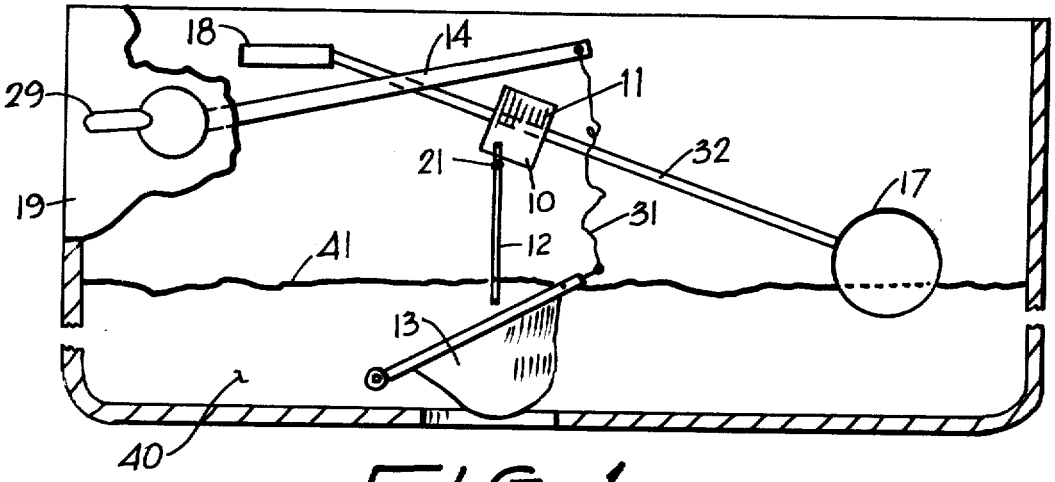
FIG. 1 is a front sectional view of the invention.

Turning now descriptively to the drawings, in which similar reference characters denote similar elements throughout the several views, FIG. 1 illustrates a toilet tank 19 equipped with the improved flush mechanism 10. The tank 19 is fitted with a conventional outlet leading to an attached toilet valve 13 that controls tank drain 20 and is linked in conventional fashion to a pull cord 31, the other end of which is fastened to the arm 14 fastened to a rotatable handle rod 23 joined to an external handle 29. A float 17 is fastened to a pivotable float arm 32 which is conventionally linked to the inlet valve 18 of the tank.

Handle rod 23 is slidably mounted in bearing 24 and is biased by compression coil spring 16 to normally push handle 29 away from the tank 19.

A two part block 11 is permanently fastened through hole 36 to float arm 32. Block 11 is fitted with a rotatable bracket 12 rotatably hinged to block 11 by hinge pin 37, with an arm 21 fastened to bracket 12 to project at an angle to bracket 12 in the plane of rotation of bracket 12 about hinge pin 37.

Figure 2:
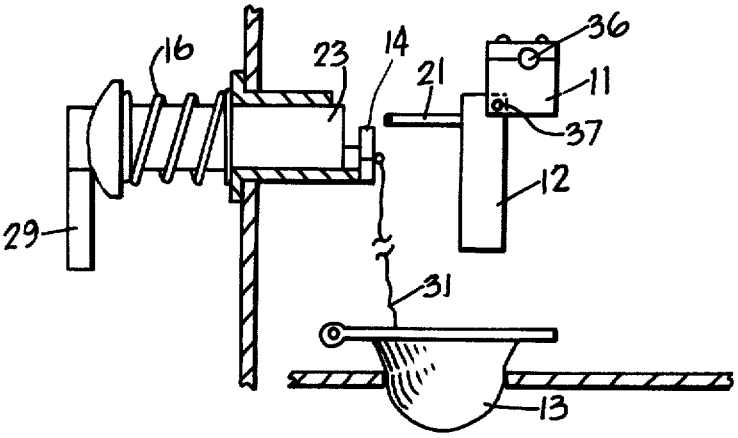
FIG. 2 is an end sectional view of the invention in position for a limited tank flush.
Figure 3:
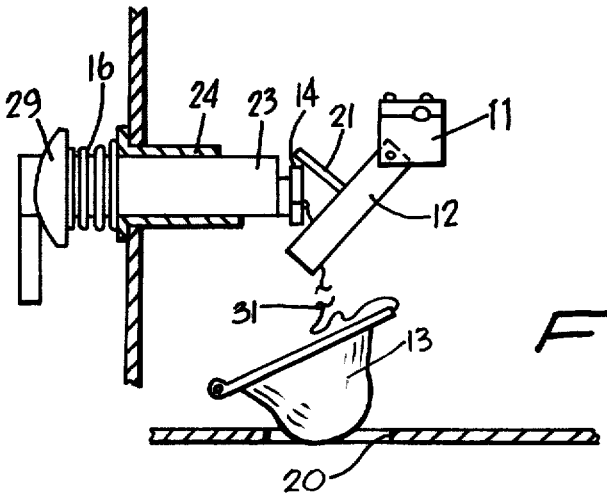
FIG. 3 is an end view of the invention in the position for a full tank flush.

In the normal position shown in FIGS. 1–2, block 12 hangs so as to engage opened outlet valve 13 as the float arm 32 descends and closes outlet valve 13 after a further descent of float arm 32. In this manner, valve 13 is closed prior to drainage of the full tank of water 40 in tank 19, to provide a limited flush of the tank when handle 29 has been initially rotated to pull cord 31 and initially open outlet valve 13.

For full flush of tank 19, handle 29 is pushed towards the tank 19 prior to rotation and then rotated to rotate handle arm 14 under block arm 21 and rotate block 12 away from engagement with outlet valve 13, as cord 31 is pulled to open valve 13. Valve 13 then remains open until the level 41 of the water in the tank falls below valve 13 since valve 13 has the normal floatation characteristics of a toilet outlet valve.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters patent of the United States is:

1. A toilet flush tank mechanism which alternately provides means to permit a limited flush of the attached toilet or a full tank flush of an attached toilet, upon actuation of the mechanism, said tank fitted with a water supply valve controlled by a pivotable arm on which a float is fastened, which pivotable means is attached to the said pivotable float arm, which pivotable means in a first position serves to engage the outlet valve of the toilet tank mechanism, when the outlet valve is in the open position and the float arm has descended from its initial position, with further descent of the float arm serving to force said means to push the outlet valve into the closed position, in which the pivotable means may be rotated to a second position away from engagement with the outlet valve so as to permit the outlet valve to operate independently of the position of the pivotable float arm.

* * * * *